US005409127A

United States Patent [19]

Stratford et al.

[11] Patent Number: 5,409,127

[45] Date of Patent: Apr. 25, 1995

[54] MULTI-PACK CONTAINER ASSEMBLY

[75] Inventors: James T. Stratford, Basye, Va.; Alan H. Schoonveld; David A. Weaver, both of Iowa Falls, Iowa

[73] Assignee: Berry Iowa Corporation, Iowa Falls, Iowa

[21] Appl. No.: 135,255

[22] Filed: Oct. 12, 1993

[51] Int. Cl.[6] ..... B65D 85/32

[52] U.S. Cl. ..... 220/23.4; 220/23.6; 220/23.8; 220/507

[58] Field of Search ..... 220/23.8, 23.6, 507, 220/23.4

[56] References Cited

U.S. PATENT DOCUMENTS

| | | | |
|---|---|---|---|
| 2,825,450 | 3/1958 | Lambert | 220/23.8 |
| 2,858,224 | 10/1958 | Darrah . | |
| 3,009,291 | 11/1961 | Blackmore . | |
| 3,021,001 | 2/1962 | Donofrio . | |
| 3,054,679 | 9/1962 | Bradford . | |
| 3,245,528 | 4/1966 | Holley | 220/23.8 |
| 3,474,928 | 10/1969 | Hurtt . | |
| 3,651,976 | 3/1972 | Chadbourne . | |
| 3,880,288 | 4/1975 | Hunter . | |
| 4,301,941 | 11/1981 | Kraft . | |
| 4,305,524 | 12/1981 | McLaren et al. . | |
| 4,339,033 | 7/1982 | Cillario . | |
| 4,364,476 | 12/1982 | Weller et al. . | |
| 4,615,444 | 10/1986 | de Larosiere . | |
| 4,798,133 | 1/1989 | Johnson . | |
| 4,799,590 | 1/1989 | Furman . | |
| 4,829,006 | 5/1989 | Smith et al. . | |
| 4,859,337 | 8/1989 | Woltermann . | |
| 4,867,315 | 9/1989 | Baldwin . | |
| 4,875,620 | 10/1989 | Lane, Sr. . | |

FOREIGN PATENT DOCUMENTS

| | | | |
|---|---|---|---|
| 1392947 | 4/1964 | France | 220/23.8 |
| 2653906 | 11/1976 | Germany | 220/23.8 |
| 649541 | 1/1948 | United Kingdom | 220/23.8 |

*Primary Examiner*—Joseph Man-Fu Moy
*Attorney, Agent, or Firm*—Barnes & Thornburg

[57] ABSTRACT

A multi-pack container assembly comprises a plurality of containers and webs joining the containers, each web configured to include an area of reduced structural integrity for tearing a plurality of frangible ribs interconnecting adjacent containers and traversing the tearing area.

29 Claims, 8 Drawing Sheets

MULTI-PACK CONTAINER ASSEMBLY

BACKGROUND AND SUMMARY OF THE INVENTION

The present invention relates to a multi-pack container assembly and, in particular, to a multi-pack container assembly having breakaway tear areas between adjacent containers to facilitate removal of each container from the container assembly. More particularly, the present invention relates to an injection-molded multi-pack container assembly.

Multi-pack container assemblies for storing several separate items are known. Individual servings of food, such as yogurt and pudding, nursery stock, or many other products can be packaged individually. These multi-pack container assemblies typically include several containers that are joined together to form a pack of individually sealed servings. Consumers will know that each container can be separated from the multi-pack so that items in the containers can be used.

Typically, conventional multi-pack container assemblies are made by thermoforming polystyrene. The "form, fill, and seal" machinery needed to make thermoformed polystyrene multi-pack containers is expensive. In addition, the container thermoforming process produces excess scrap polystyrene material. These scraps of material must be collected and disposed of, which is wasteful. Generation of this scrap thus adds cost to the manufacturing of polystyrene thermoformed multi-pack containers. Another problem associated with the use of polystyrene in thermoforming processes is that not many facilities are currently set up to recycle polystyrene. There is also a cost associated with reclaiming scrap material that can be recycled if a recyclable material is used in the manufacture of a thermoformed multi-pack container assembly.

A further disadvantage of multi-pack containers thermoformed from polystyrene is that polystyrene is a brittle material. The brittleness of polystyrene causes it to fracture at unintended spots on the container during separation of the container from the multi-pack, causing the contents of the container to be spilled from the fractured container. This has the disadvantage of both wasting the product and causing an unwelcome mess that must be cleaned up.

It is also known to use cardboard to bundle several separate containers made of plastics material, such as polypropylene, together to provide a multi-pack container assembly. The manufacturing process used to produce cardboard-bundled individual polypropylene containers is expensive. Material costs are higher because cardboard must be used in addition to plastics material. Assembly costs are higher because separate cardboard-handling machinery is needed to bundle the individual containers together.

Another disadvantage of cardboard-bundled polypropylene containers is that a consumer must tear through the cardboard in order to get a container which separates the containers from one another. Once separated, containers are no longer stored as easily as when bundled.

An improved multi-pack container assembly would benefit consumers and also enable dairy processors to enter into the multi-pack yogurt market. Currently, to enter the market a food processor must either purchase a very expensive form, fill, and seal machine which produces a polystyrene, thermoformed package or use cardboard to unite individual containers to form a multi-pack. An improved multi-pack container assembly made of recyclable plastics material using an injection-molding process would solve recycling problems associated with thermoforming polystyrene and would enable a food producer or other packager to enter into the multi-pack market without a large capital investment or high operational and raw material costs.

Accordingly, the present invention provides an injection-molded multi-pack container. The multi-pack container includes a number of individual containers that are joined together by a web. The individual containers each include a skirt, a downwardly extending body, and a stack shoulder joined between the skirt and downwardly extending body. The skirt is located adjacent an opening into cavities in the bodies in which a product is contained. The web includes a tear area between containers that allows individual containers to be removed from the multi-pack.

In preferred embodiments, the multi-pack container is made of high-density polyethylene and includes frangible or breakable ribs that traverse the channels of the tear area of the web. These frangible ribs provide strength reinforcement to the web to reduce the likelihood of inadvertent separation of a container from the multi-pack. The frangible ribs each include a weakened portion that facilitates breaking of the ribs when a consumer desires to remove a container from the multi-pack.

The tear area is defined by an array or matrix of intersecting channels formed in the web. These channels are formed primarily on the back side of the web which is adjacent the downwardly extending bodies which define the containers and are appended to the back side of the web. The "tear area" channels are formed so that they have varying thicknesses at different points along the web. The portion of the channels in the vicinity of the ribs is made thinner so as to aid in the removal of a container from a multi-pack. Thinning the channel in the area of the ribs lessens the likelihood of tearing the stack shoulders or body portions of the containers during removal from the multi-pack.

The tear area channels are also thinned out in the areas where they intersect and join four adjacent containers to the multi-pack. This thinning allows a consumer to tear the web portion joining the four adjacent containers more easily.

Stack shoulders are formed on each container to limit the depth of insertion of one multi-pack container assembly into another underlying multi-pack container assembly. Limitation of the depth of insertion of multi-pack container assemblies into one another during stacking or nesting of such assemblies helps reduce the formation of vacuum between nested or stacked multi-pack containers. Reduction in the formation of vacuum allows nested multi-pack containers to be separated more easily.

Illustratively, a weld bead is formed on an outer lip surrounding the top opening of each individual container. Each weld bead is generally rectangular and includes a substantially flat top. The weld bead functions to thermally isolate the tear area of the web in order to reduce thermal deformation of the tear area when the foodreceiving cavities in the containers are covered by foil and thermally sealed using a heated foil-engaging mandrel. In addition, the weld bead provides a good, flat surface for uniform sealing of the containers using such means as a perforated foil.

The injection-molded polyethylene multi-pack container assembly of the present invention is well-suited for consumer use. Expensive thermoform machinery is not needed to construct the polyethylene injection-molded multi-pack container assembly. In addition, little scrap material is generated during the formation of the multi-pack container assembly of the present invention. In addition, injection-molded polyethylene is less brittle than thermoformed polystyrene and thus will not tear as easily in unintended areas and spill product when an individual container is separated from a multi-pack. This helps reduce product wastage and spillage clean-up. Furthermore, high-density polyethylene (HDPE) is the most desirable material to recycle. Many facilities are currently set up to recycle polyethylene.

The injection-molded polyethylene multi-pack container assembly of the present invention is also believed to be less expensive to manufacture than individual injection-molded containers that are bundled together with cardboard. In addition, the injection-molded polyethylene multi-pack container assembly of the present invention is not destroyed or damaged by the removal of a single container as with bundled polypropylene containers. This allows the multi-pack container assembly of the present invention to continue to provide its excellent storage advantages.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
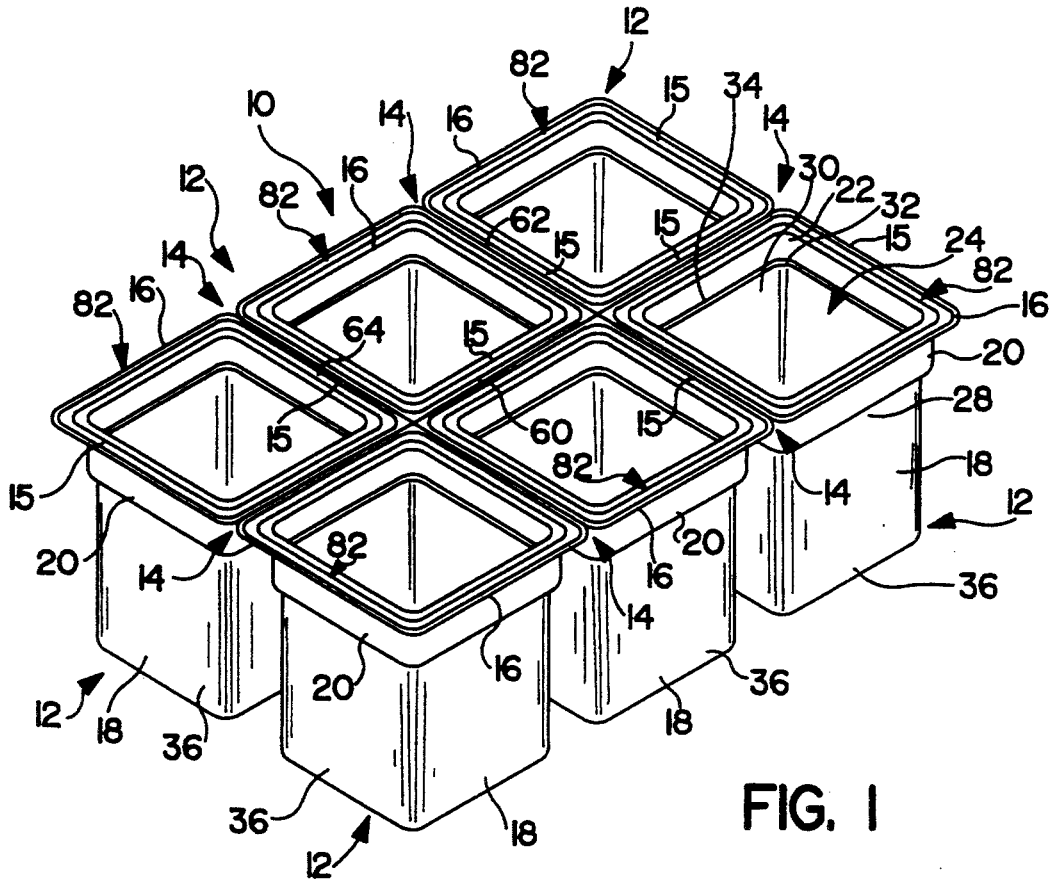
FIG. 1 is a perspective view of an injection-molded multi-pack container assembly in accordance with the present invention showing six containers and a web interconnecting adjacent containers to hold the containers together as a six-pack.
Figure 11:
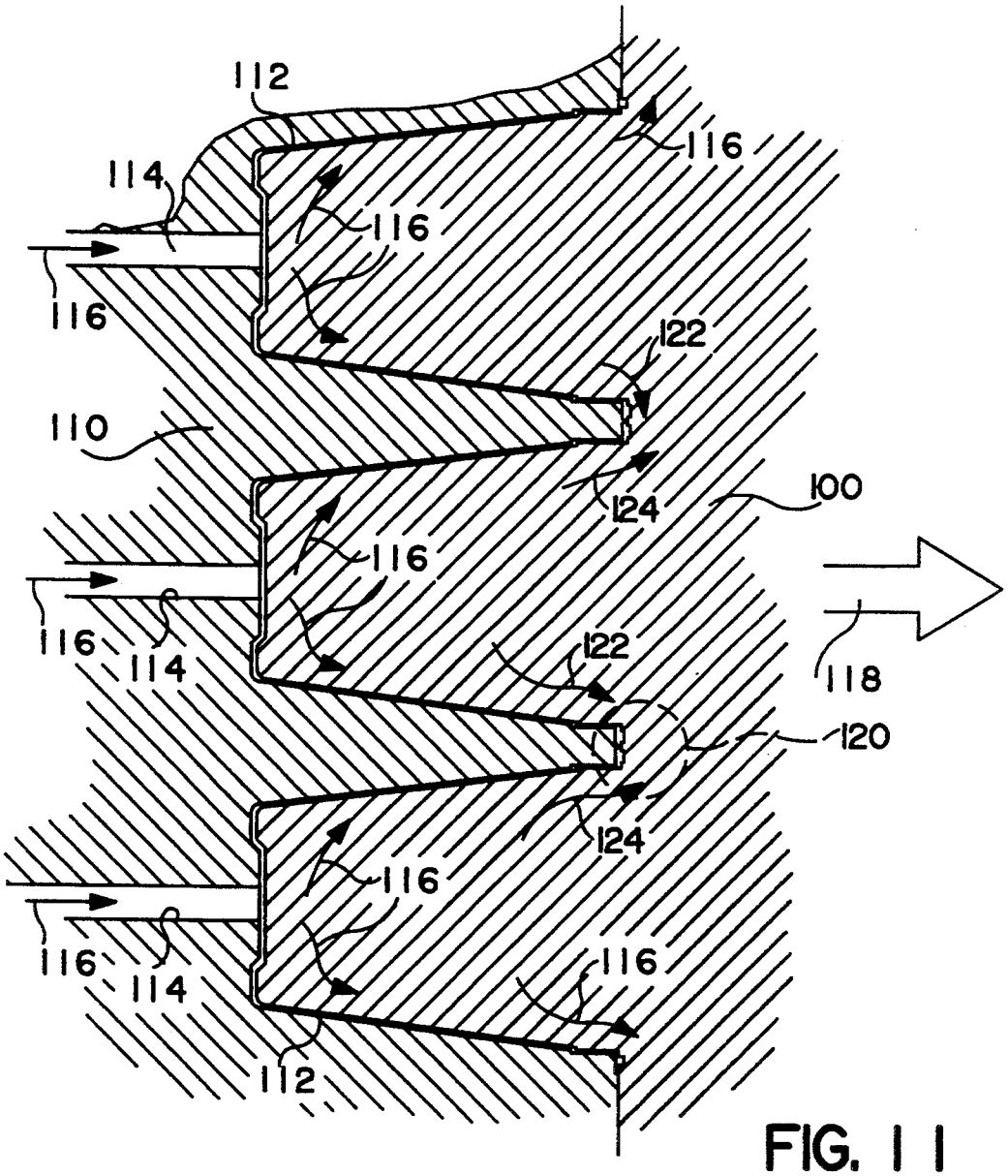
FIG. 11 is a side view of an injection-molding process used to form injection-molded multi-pack containers of the present invention showing a female mold formed to include plastic-injection mold feed gates for each container-forming cavity provided in the female mold, and a mating male mold.

Multi-pack container 10 includes a plurality of individual containers 12 that are joined together by a web 14 as shown in FIG. 1. Multi-pack container 10 is preferably formed from injection-molded high-density polyethylene (HDPE) using a mold as shown in FIG. 11. It is within the scope of the present invention to form multi-pack container 10 by injection-molding using other suitable plastics materials known to those of ordinary skill in the art. Each individual container 12 is formed to include a skirt 16, a downwardly extending hollow body 18, and a stack shoulder 20 formed between skirt 16 and downwardly extending hollow body 18. Each generally rectangular skirt 16 is formed to lie adjacent to and around adjacent a top aperture 22 opening into a cavity 24 formed in downwardly extending body 18. Cavities 24 are configured to store any suitable product or material. For example, nursery products could be stored in cavities 24. Also, cavities 24 could contain a food such as yogurt or pudding to be consumed when an individual container 12 is removed from multi-pack container assembly 10. Although a "six-pack" container assembly 10 is shown, it will be understood that it is within the scope of the present invention to provide an assembly having more than one container.

Stack shoulders 20 are formed to include exterior corners 26 that outwardly extend away from body 18 as shown in FIG. 1. Stack shoulders 20 are further formed to include outwardly extending exterior ledges 28 that extend outwardly from bodies 18 and interconnect exterior corners 26. Interior surfaces 30 of each of containers 12 are formed to include interior corners 32 that extend inwardly toward interior cavities 24. Interior ledges 34 are also formed on interior surfaces 30 and interconnect internal corners 32. Corners 26 and 32 and ledges 28 and 34 interact with one another when multiple multi-pack container assemblies 10 are stacked together in nested relation as will be discussed below in connection with FIG. 13.

Figure 2:
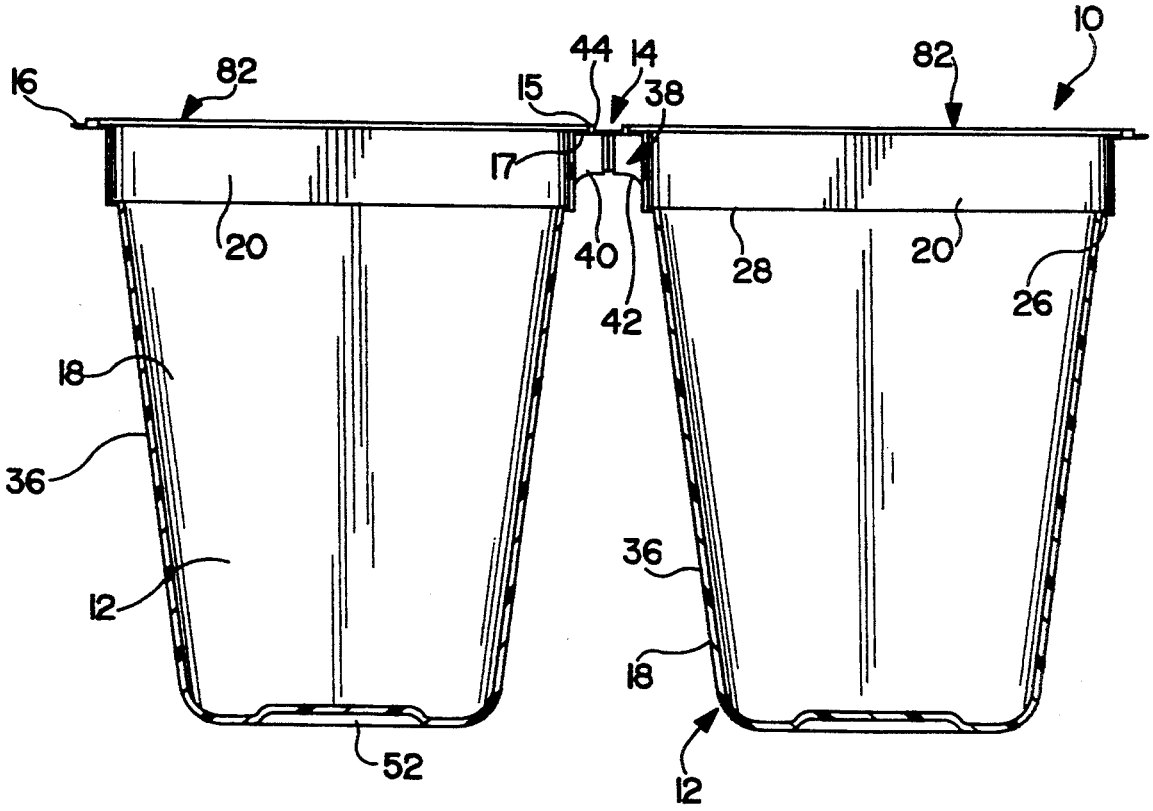
FIG. 2 is an end view of the multi-pack container assembly shown in FIG. 2 showing a notched frangible rib interconnecting two adjacent containers and a thin portion of a channel formed in the back wide of the web and adjacent to the frangible rib.

FIG. 2 is an end view of the multi-pack container 10 shown in FIG. 1. The inward tapering of sides 36 of downwardly extending hollow bodies 18 is shown in FIGS. 1 and 2. The inward tapering of sides 36 facilitates stacking of multiple multi-pack container assemblies 10 as will be discussed below in connection with FIG. 13. The skirts 16 of adjacent containers 12 cooperate to define web 14 so as to join containers 12 together as shown in FIGS. 1 and 2. The web 14 includes a top wall 15 around the top aperture 22 opening into each cavity 24 and a bottom wall 17 around each downwardly extending hollow body 18 as shown best in FIGS. 2, 3, and 5.

Figure 3:
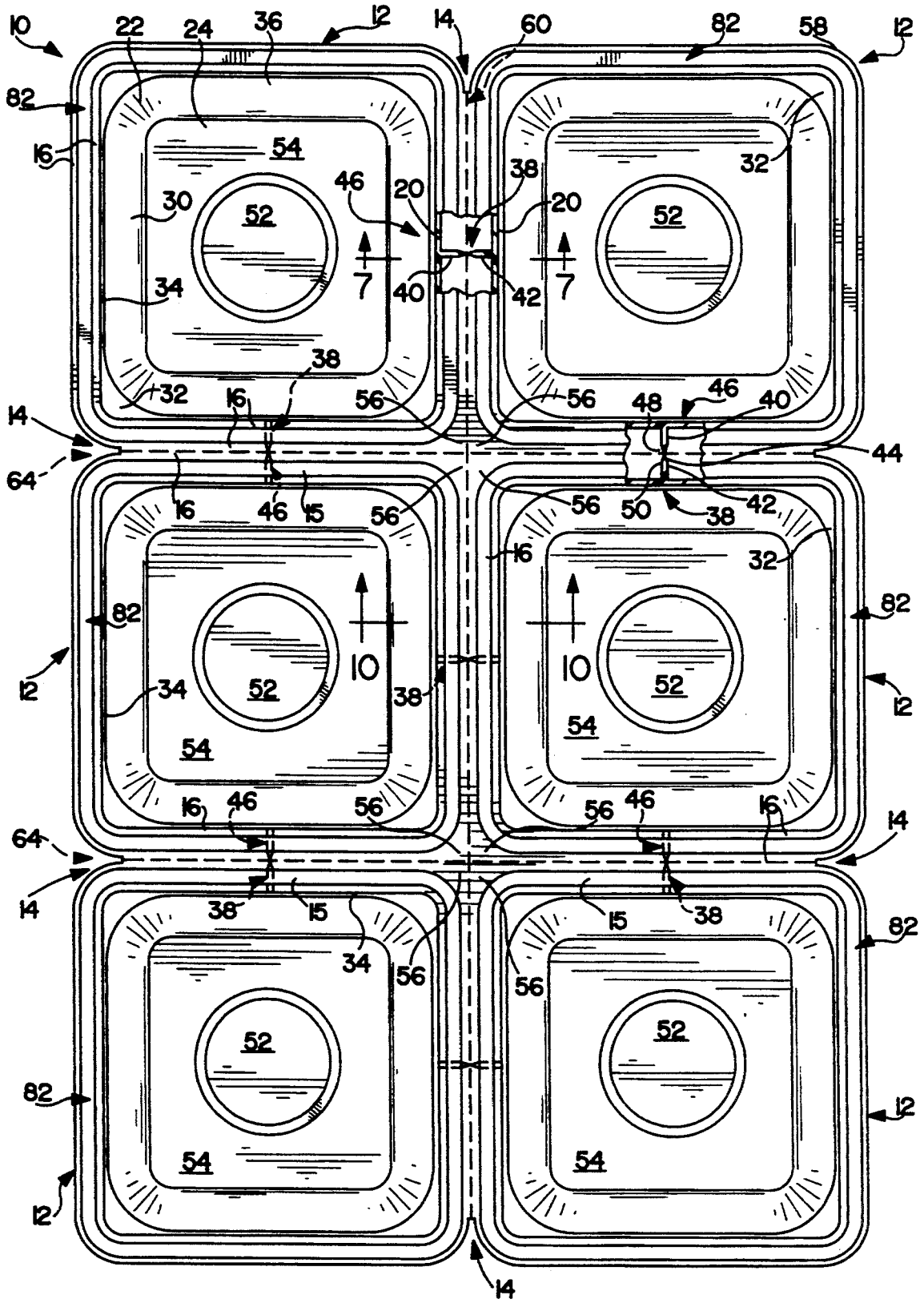
FIG. 3 is a top plan view of the multi-pack container assembly, with portions broken away, to show two frangible ribs interconnecting adjacent containers.

A frangible rib or gusset 38 is attached to web and stack shoulders 20 of adjacent containers 12 as shown best in FIGS. 2, 3, 5, and 7. Frangible rib 38 provides strength reinforcement to web 14 to reduce inadvertent separation of container 12 from multi-pack container assembly 10. Frangible rib 38 includes first and second portions 40, 42, and each portion 40, 42 is attached to a stack shoulder 20 as shown in FIGS. 2 and 3. Portions 40 and 42 form a thin plate interconnecting adjacent containers 12. An enervated or weakened portion 44 connects first and second frangible rib portions 40 and 42 together.

A top plan view of multi-pack container 10 of the present invention with portions broken away to show locations of frangible ribs 38 is shown in FIG. 3. As can be seen in FIG. 3, frangible ribs 38 are located at midpoints 46 of sides 36 along a straight portion of web 14 lying between adjacent containers 12.

Figure 7:
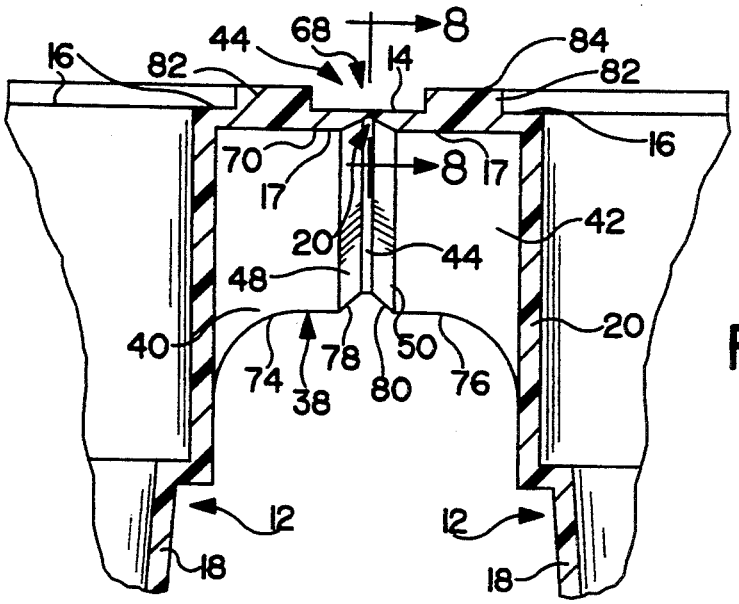
FIG. 7 is an enlarged view taken along line 7—7 of FIG. 3 showing the frangible rib and breakaway channel in the web adjacent to the frangible rib.
Figure 9:
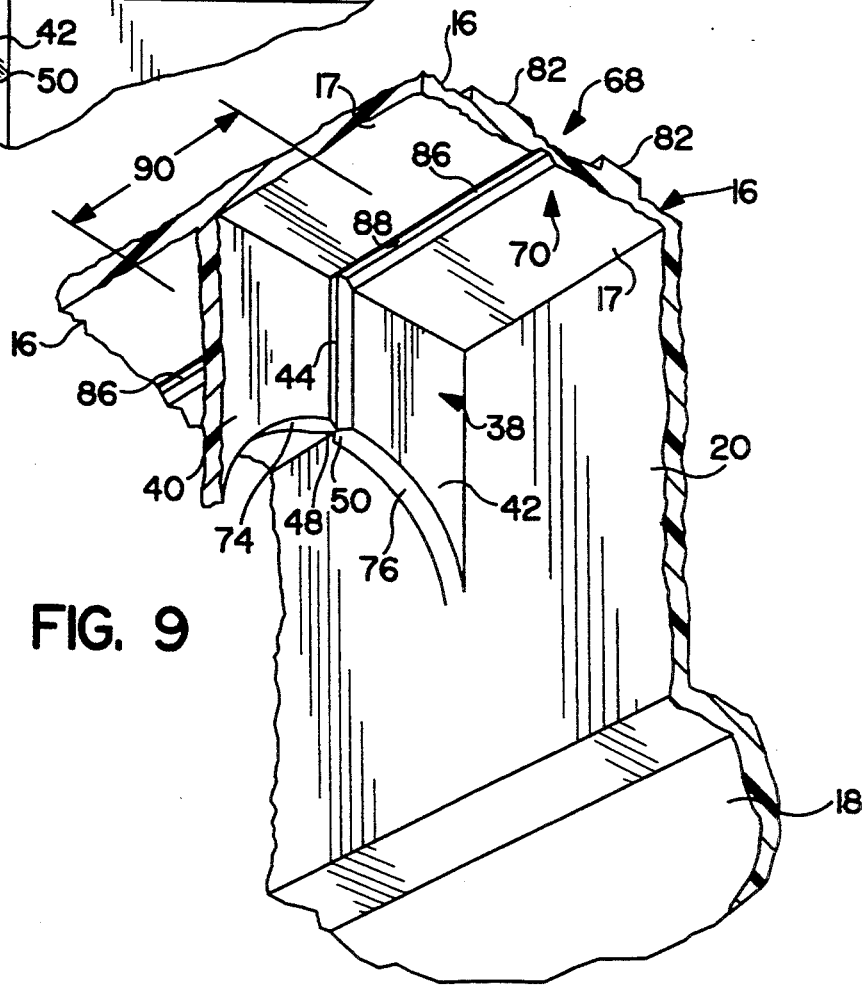
FIG. 9 is a bottom perspective view of the tear area illustrated in FIG. 7 showing the breakaway channel in the web and the frangible rib traversing the web and the breakaway channel.

Edge portions 48 and 50 of respective first and second frangible rib portions 40 and 42 are beveled or tapered adjacent enervation 44 as shown in FIGS. 3, 7, and 9. Beveling of edge portions 48 and 50 further enhances the frangibility of ribs 38.

Figure 13:
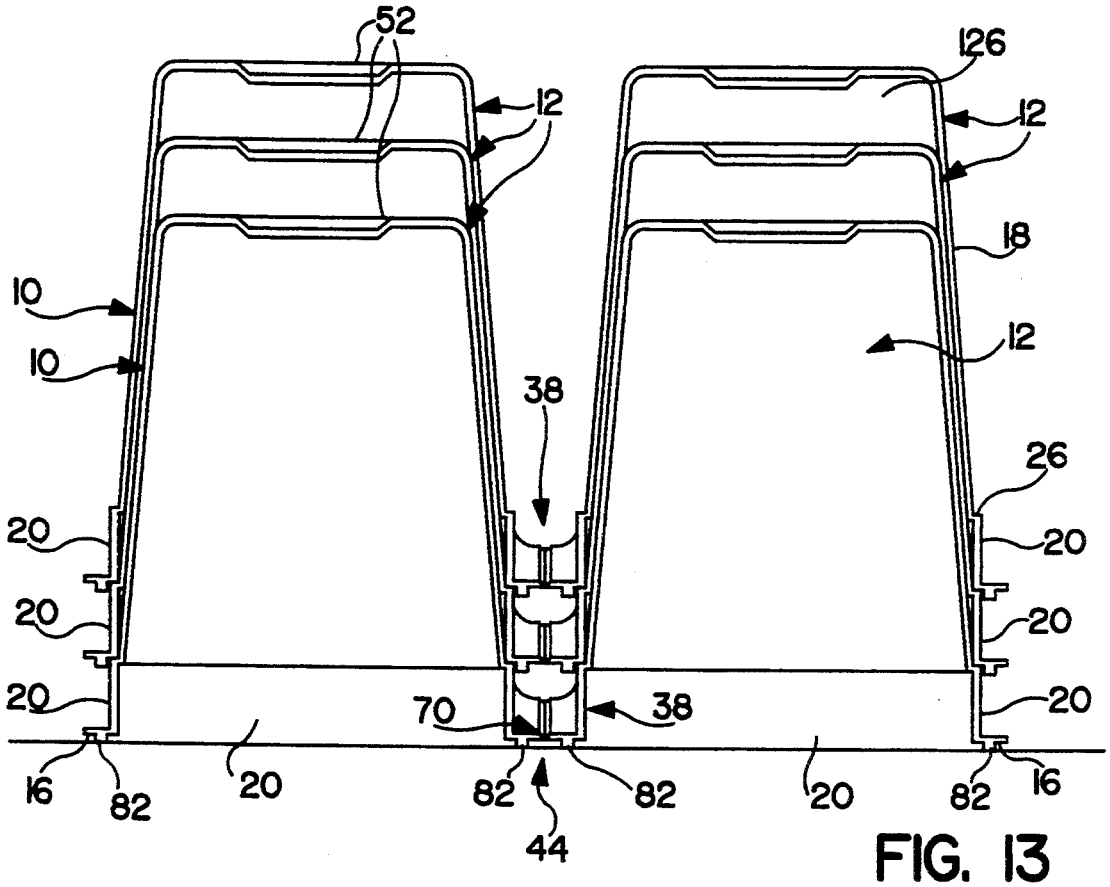
FIG. 13 is a sectional view of a plurality of multi-pack containers that are stacked together in nested relation to one another.

The inward tapering of container sides 36 can be seen in FIG. 3 as well as a round raised portion 52 formed in the bottoms 54 of each of containers 12. Raised portions 52 extend inwardly into cavities 24 of containers 12 as can be seen in FIGS. 2 and 13. Inwardly extending interior corners 32 and inwardly extending interior ledges 34 can also be seen.

Figure 4:
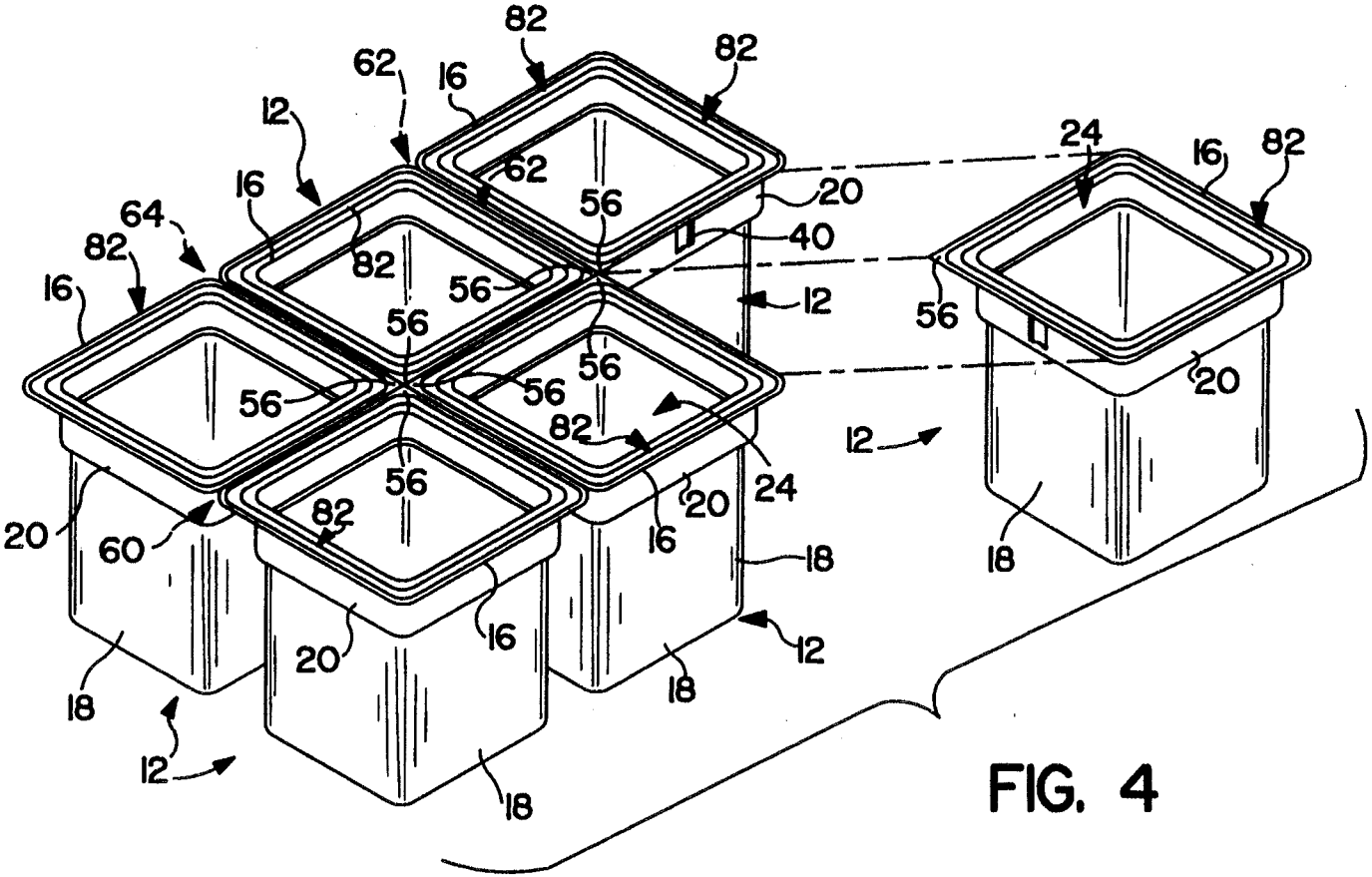
FIG. 4 is a perspective view of the injection-molded multi-pack container assembly of FIG. 1 after one of the containers has been removed.

Corners 56 of skirt 16 form a "quad" portion of web 14 where four individual containers 12 are joined together. As can be seen in FIGS. 3 and 4, corners 56 are formed at generally right angles. This shape results from the fact that multi-pack container assembly 10 is injection-molded. Corners 56 of skirts 16 have a reduced cross-sectional thickness that is less than the thickness of other portions of skirts 16. This makes corners 56 more flimsy than the other three generally curved corners 58 of containers 12.

First, second, and third channels 60, 62, and 64 define a weakened tear area in web 14 between adjacent containers 12 that facilitates manual removal of containers 12 from multi-pack container assembly 10. A first channel is formed in web 14 extending along the longitudinal length thereof and is generally indicated by line 60 in FIG. 3. A second channel generally transverse to first channel 60 is formed along the width of web 14, transverse to channel 60 generally indicated by line 62 in FIG. 3. A third channel, also formed along the width of web 14, is generally indicated by line 64 in FIG. 3. First, second, and third channels 60, 62, and 64 are formed in the bottom wall 17 of web 14 as will be discussed in more detail below in connection with FIGS. 7–10.

A perspective view of injection-molded multi-pack container assembly 10 with an individual container 12 removed therefrom is shown in FIG. 4. A first portion 40 of frangible rib 38 is shown as connected to a stack shoulder 20 of a container 12 that remains joined to multi-pack container assembly 10. As can be seen in FIG. 4, additional containers 12 remain joined to multi-pack container assembly 10.

Figure 5:
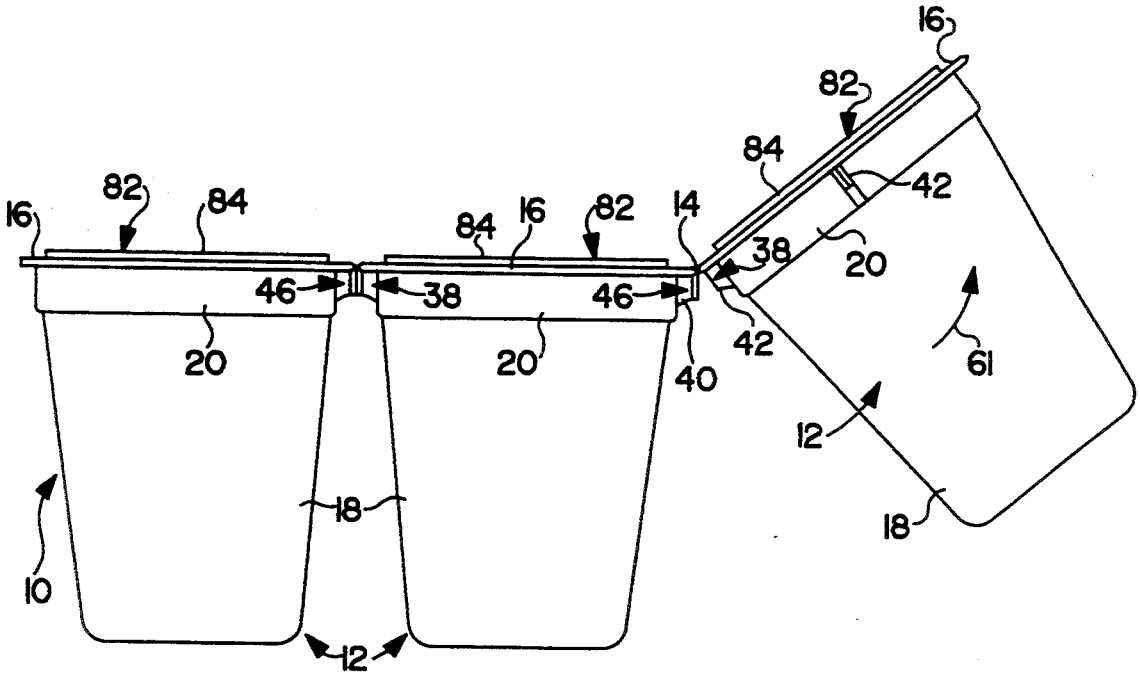
FIG. 5 is a side elevation view of the multi-pack container assembly showing breakage of the frangible rib interconnecting two adjacent containers during part of the process used to remove an individual container from the multi-pack container assembly.
Figure 6:
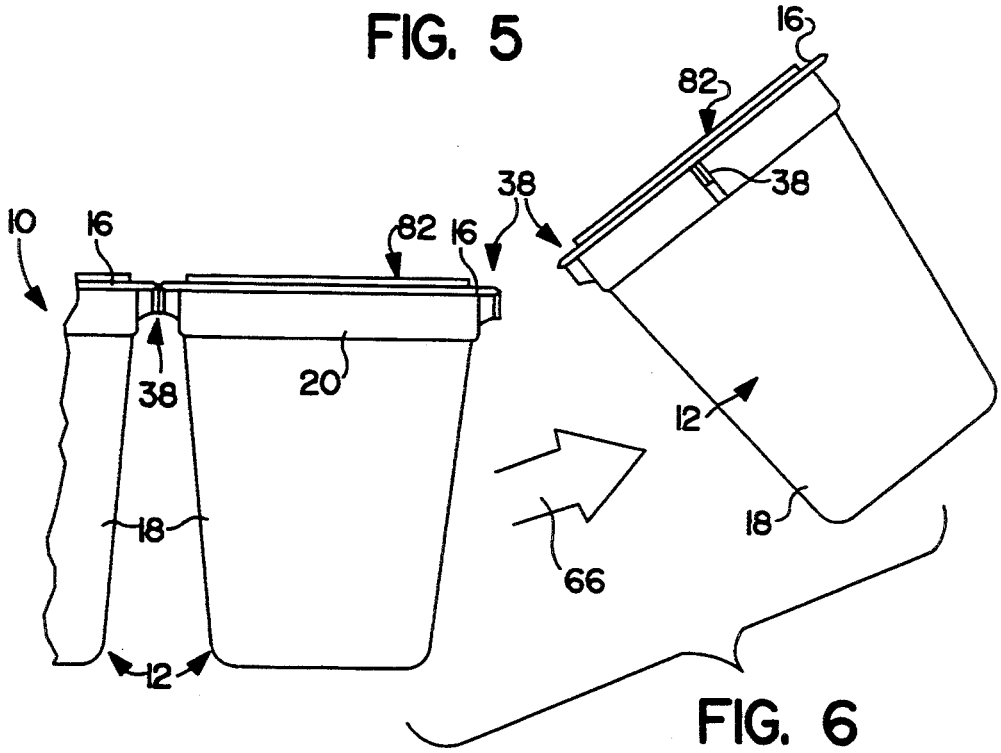
FIG. 6 is a view similar to FIG. 5 showing detachment of one of the containers from the multi-pack container assembly.

A side view of multi-pack 10 during part of the process used to remove an individual container 12 from multi-pack 10 is shown in FIGS. 5 and 6. Container 12 is being pivoted upwardly in direction 61 so as to break apart first and second portions 40 and 42 of frangible rib 38 along enervation line 44. Container 12 is also being pivoted upward to break or tear web 14 which joins it to an adjacent container 12 of multi-pack 10. A side view of the same multi-pack container shown in FIG. 5 after removal of container 12 in the general direction of arrow 66 is shown in FIG. 6. Although removal of container 12 has been shown diagrammatically as a "two-step" process in FIGS. 5 and 6, it will be understood that removal of a container 12 from assembly 10 can actually be accomplished using a "one-step" tearing action which tears frangible rib 38 and enervation line 44 at essentially the same time.

A side view of a tear area 68 formed in web 14 between two adjacent containers 12 of multi-pack container assembly 10 is shown in FIG. 7. First and second portions 40 and 42 of frangible rib 38 are also shown. Tear area 68 is formed from a channel 70 formed in the bottom wall 17 of web 14. Channel 70 is formed such that it has two thicknesses as will be discussed below in connection with FIG. 8.

The connection of first and second portions 40 and 42 of frangible rib 38 to stack shoulders 20 of containers 12 is shown in FIG. 7. As can be seen, first and second portions 40 and 42 are curved on lower portions 74 and 76. Enervation 44 is shown as being disposed between and attached to beveled edge portions 48 and 50. Notches 78 and 80 are formed in respective edge portions 48 and 50. Notches 78 and 80 further enhance the frangibility of ribs 38 during removal of a container 12 from multi-pack container 10.

A rectangular-shaped weld bead 82 with rounded corners is formed on a top wall of each skirt 16 as shown best in FIGS. 1, 3, 4, 7, and 9. Weld bead 82 provides a structure for thermally isolating tear area 68 formed in web 14 during heat-sealing of a cover applied to top wall 15 of web 14 to seal food products (not shown) inside the cavities 24 provided in multi-pack container assembly 10. As can be seen, weld beads 82 are generally rectangular in cross-section and have a substantially flat top. The top of weld bead 82 is substantially flat so as to facilitate the provision of a flat and uniform seal of cavities 24 of containers 12.

Figure 8:
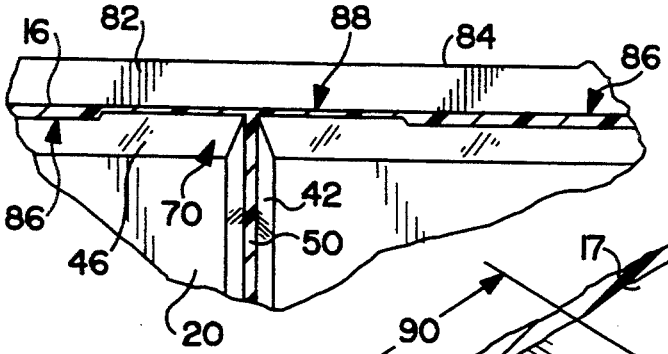
FIG. 8 is an enlarged view taken along line 8—8 of FIG. 7.

FIG. 8 is enlarged from the view that would otherwise be visible from the cross-section along line 8—8 of FIG. 7 in order to show detail regarding the depths of channels 70 formed in web 14. Second portion 42 of frangible rib 38 is shown as is beveled edge portion 50 and weld bead 82. Skirt 16 is also shown as is stack shoulder 20 to which second portion 42 of frangible rib 38 is attached. As discussed above in connection with FIG. 7, channel 70 formed in tear area 68 of web 14 is formed such that it has a first bottom wall portion having a first thickness 86 and a second bottom wall portion having a second thickness 88. As can be seen in FIG. 8, first thickness 86 is greater than second thickness 88. In one embodiment, first thickness 86 is approximately seven thousandths of an inch and second thickness 88 is thinned down from first thickness 86 to approximately five thousandths of an inch.

Figure 15:
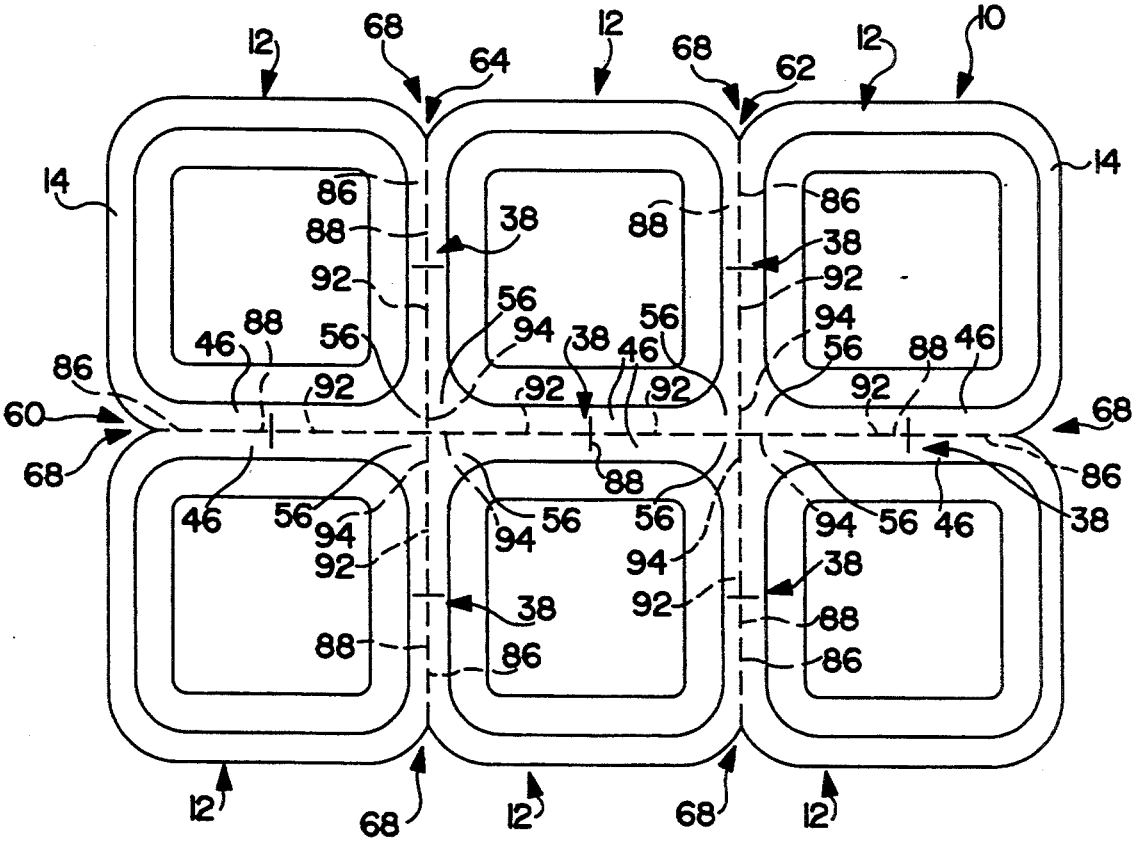
FIG. 15 is a diagrammatic bottom plan view of the multi-pack container assembly of FIG. 1 showing location of thin and thick portions in the longitudinal and transverse breakaway channels formed in the web to lie between adjacent containers.

As can be seen in FIGS. 7, 8, and 15, second thickness 88 is located adjacent rib 38 at midpoints 46 where it is attached between adjacent containers 12 of multi-pack container assembly 10. Second thickness 88 is positioned to lie between a spaced-apart pair of first thicknesses 86, 92 as shown diagrammatically in FIG. 15. Second thickness 88 is formed in tear area 68 of web 14 in order to reduce tearing of stack shoulder 20 and body 18 during separation of a container 12 from multi-pack container assembly 10. If either or both stack shoulder 20 or body 18 are torn during removal of a container 12 from multi-pack container assembly 10, product contained within cavity 24 may be spilled. Such waste of product is both expensive and produces a mess that must be cleaned.

A bottom perspective view of tear area 68 shown in FIG. 7 is illustrated in FIG. 9. First and second portions 40 and 42 of frangible rib 38 are also shown. Beveled edges 48 and 50 and enervation 44 are further shown. Finally, the length of second thickness 88 extending adjacent frangible ribs 38 is generally indicated by double-headed arrow 90.

Figure 10:
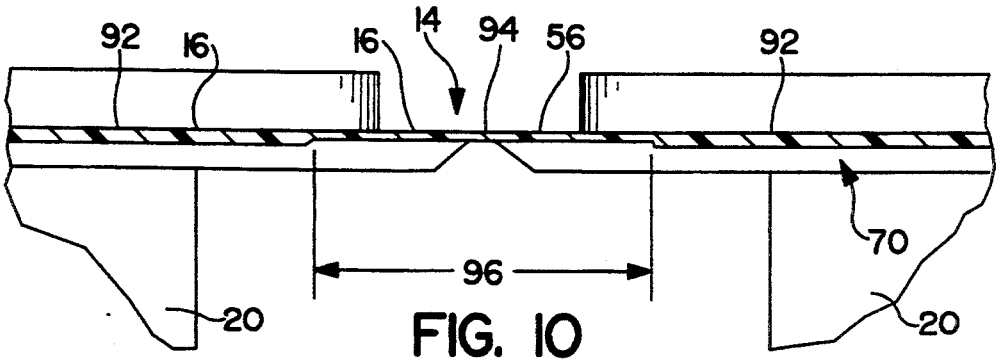
FIG. 10 is an enlarged view taken along line 10—10 of FIG. 3.

A "quad corner" area of multi-pack container assembly 10 where four individual containers 12 are joined together is shown in FIGS. 10 and 15. Tear area 68 is shown as being formed in web 14. This portion of web 14 is formed by intersecting generally right angled corners 56 of skirt 16. As can be seen in FIG. 10, channel 70 is formed to include first and second thicknesses 92 and 94 in the area near the interconnection of four containers 12. Two second thicknesses 94 in each quad corner area are arranged to form a cross-shaped member as shown in FIG. 15. Multi-pack container assembly 10 includes two spaced-apart cross-shaped members 94 as shown in FIG. 15. As can be seen in FIG. 10, first thickness 92 is greater than second thickness 94. As can further be seen, second thickness 94 is formed for only a predetermined length 96 of channel 70. Provision of a second thickness 94 weakens the quad corner area generally and aids in the removal of a container 12 from multi-pack 10. In one embodiment, first thickness 92 is approximately seven thousandths of an inch and second thickness 94 is approximately five thousandths of an inch.

A side view of the injection-molding process used to form a multi-pack container assembly 10 in accordance with the present invention is illustrated in FIG. 11. FIG. 11 shows a male mold member 100 that is disposed in female mold member 110. Male mold member 100 and female mold member 110 define a cavity 112 into which high-density polyethylene (HDPE) or other suitable plastics material is injected through six gates 114 formed in female mold member 110. The flow of the high-density polyethylene through cavity 112 is generally indicated by arrows 116. High-density polyethylene flows into cavity 112 to assume the shape of a multi-pack container assembly 10. Subsequent to formation of a multi-pack container assembly 10, male mold member 100 is removed from female mold member 10 in the direction generally indicated by large double arrow 118. The completed multi-pack container assembly 10 is then ejected from male mold member 100.

Figure 12:
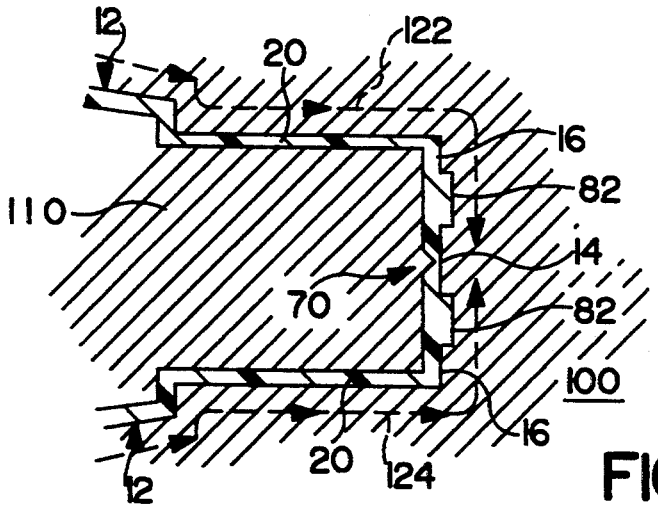
FIG. 12 is an enlarged view of the area within the circle in FIG. 11 showing how plastics material flows from two containers to meet at a weld line forming the weakened breakaway channel in the web during molding of the multi-pack container assembly.

FIG. 12 shows an enlarged view of the area within dashed circle 120 in FIG. 11. Flow of high-density polyethylene from two different directions is generally indicated by arrows 122 and 124. In addition, cross-hatching of stack shoulders 20, skirts 16, and weld beads 82 of adjacent containers 12 is reversed to further emphasize that high-density polyethylene material forming containers 12 flows from different gates 114 to meet at a "weld line" formed in frangible web 14. This is called a weld line because the plastics material from each container 12 flows together to form a "weld" joining together adjacent containers. The weld line is strong enough to join the containers 12 together, but weak enough (as a result of the configuration of the tear area around the weld line) to allow a consumer to separate one container 12 from another container 12 by tearing along the weld line.

A plurality of multi-pack containers 10 can be stacked together in a nested relation to one another as shown in FIG. 13. As discussed above, stack shoulders 20 of containers 12 are each formed to include outwardly extending exterior corners 26 that are connected together by outwardly extending exterior ledges 28. As also discussed above, interior surfaces 30 of each of containers 12 are formed to include inwardly extending interior corners 32 that are connected together by inwardly extending interior ledges 34. Outwardly extending exterior corners 26 and ledges 28 provide surfaces for engaging with inwardly extending interior corners 32 and ledges 34 to limit the depth of insertion of body portions 18 of containers 12 of a multi-pack container assembly 10 within cavities 24 of individual containers 12 of another multi-pack container assembly 10. Limiting the depth of insertion of a multi-pack container assembly 10 within another multi-pack container assembly 10 minimizes formation of any vacuum in cavity portions 126 between adjacent stacked multi-pack container assemblies 10. Reduction of any vacuum in cavity portions 126 allows stacked multi-pack container assemblies 10 to be separated more easily.

Figure 14:
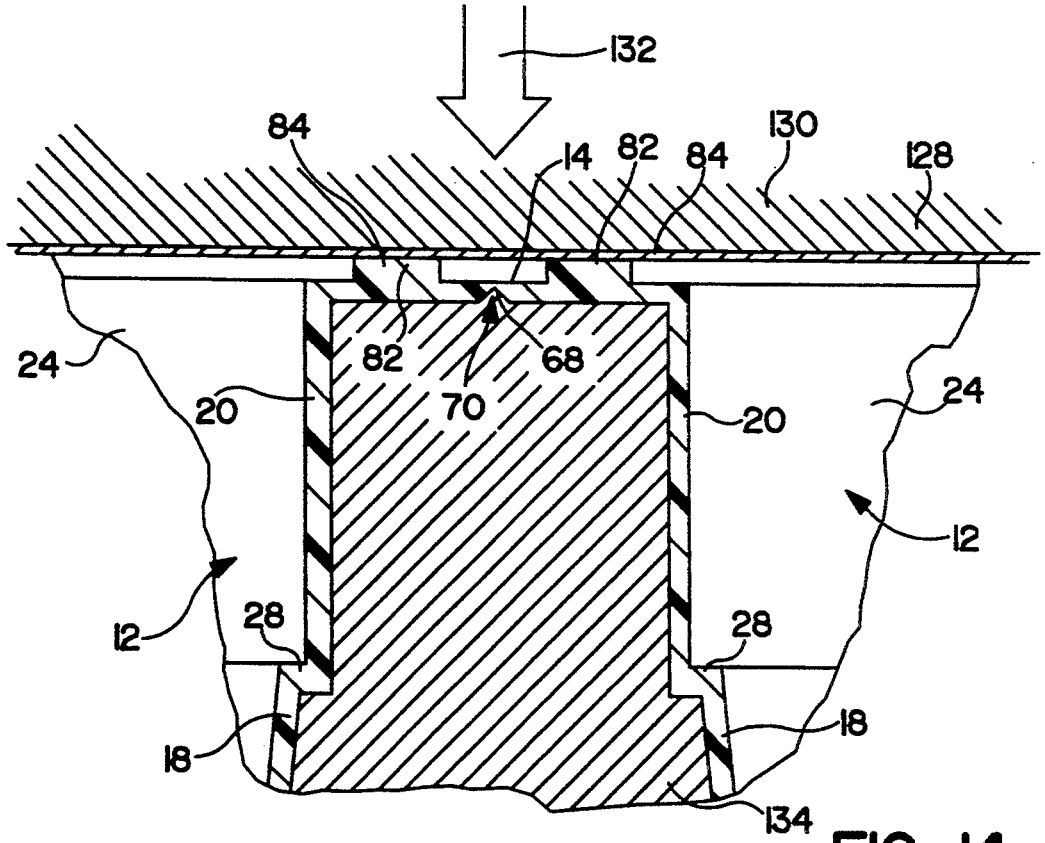
FIG. 14 is a sectional view of a portion of the multi-pack container assembly during attachment of a foil seal closure onto weld beads formed along a top surface of each of the skirts of containers of the multi-pack container assembly using a heated foil-engaging mandrel and a container-supporting mandrel.

A side view of a multi-pack container assembly 10 during application of a foil seal 128 to weld beads 82 of adjacent containers 12 by a heated mandrel 130 is shown in FIG. 14. Large double arrow 132 generally indicates a pressure that is applied to heated mandrel 130 during sealing of cavities 24 of containers 12 by foil seal closure 128. As can be seen in FIG. 14, weld beads 82 provide a structure for thermally isolating web 14 and tear area 68 thereof from thermal deformation during application of heat and pressure by heated mandrel 130. In addition, the substantially flat top surface 84 of weld bead 82 helps facilitate the provision of a flat and uniform seal by foil seal 128 of container 24. A generally flat seal helps maintain the freshness of the food contained within cavities 24 of individual containers 12. This gives the food contents of a multi-pack container assembly 10 a longer shelf life.

A lower support mandrel 134 is shown as engaging outwardly extending ledges exterior 28 of containers 12. Lower support mandrel 134 helps reduce the likelihood that web 14 joining individual containers 12 will fracture during application of pressure by heated mandrel 130 during sealing of cavities 24 by foil seal 128.

Although the invention has been described in detail with reference to certain preferred embodiments, variations and modifications exist within the scope and spirit of the invention as described and defined in the following claims.

We claim:

1. A multi-pack container assembly comprising a plurality of containers, each container being formed to include a hollow body portion and a top aperture opening into the hollow body portion, a web interconnecting the containers, the web including a top wall lying adjacent to the top apertures of the containers and a bottom wall lying adjacent to the hollow body portions of the containers, a first channel formed in the bottom wall of the web, the first channel defining a first tear area between a first set of adjacent containers, a second channel formed in the bottom wall of the web, the second channel intersecting the first channel and defining a second tear area between a second set of adjacent containers, and a plurality of frangible ribs, each rib extending transverse and traversing one of the first and second channels.

2. The multi-pack container assembly of claim 1, wherein there is one frangible rib interconnecting each pair of adjacent containers.

3. The multi-pack container assembly of claim 1, wherein each frangible rib is formed to include a notch lying between each pair of adjacent spaced-apart hollow body portions.

4. The multi-pack container assembly of claim 1, wherein there is one frangible rib interconnecting each pair of adjacent containers.

5. The multi-pack container assembly of claim 4, wherein each frangible rib includes a thin plate interconnecting each pair of adjacent spaced-apart hollow body portions and a notch formed in a central portion of each thin plate.

6. The multi-pack container assembly of claim 1, wherein the web includes a thick portion defining a first part of a bottom wall underlying each of the first and second channels and a thin portion defining a second part of the bottom wall underlying each of the first and second channels and the thick portion has a thickness that is greater than a thickness of the thin portion.

7. The multi-pack container assembly of claim 6, wherein the thin portions are located proximate midpoints on the web where adjacent containers are joined.

8. The multi-pack container assembly of claim 7, wherein the thin portions are also located at points on the web where the first and second channels intersect.

9. The multi-pack container assembly of claim 6, wherein the thin portions are located at points on the web where the first and second channels intersect.

10. A multi-pack container assembly comprising a plurality of containers, a web joining said containers, the web configured to include an area of reduced structural integrity for tearing, a plurality of frangible ribs interconnecting adjacent containers and traversing said area, and wherein said area provides for separation along a first plane and the ribs are frangible along a second plane transverse to the first plane.

11. The multi-pack container assembly of claim 10, wherein each container is formed to include a hollow body portion and a top aperture opening into the hollow body portion, the web includes a top wall lying adjacent to the top apertures of the containers and a bottom wall lying adjacent to the hollow body portions of the containers and the area is formed in the bottom wall of the web.

12. The multi-pack container of claim 11, further comprising means for enhancing the frangibility of said ribs.

13. The multi-pack container assembly of claim 12, wherein the enhancing means includes enervations formed in the ribs.

14. The multi-pack container assembly of claim 13, wherein portions of said ribs are beveled adjacent said enervations.

15. The multi-pack container assembly of claim 13, wherein the enhancing means further includes a notch formed in each of said ribs and arranged to lie adjacent the enervations.

16. A multi-pack container assembly comprising a plurality of containers, each container having a generally rectangular cross-section with four corners and four sides, and being formed to include a hollow body portion and a cavity in the hollow body portion, a web interconnecting the containers, the web having a top wall lying adjacent to openings of the cavities and a bottom wall lying adjacent to the hollow body portions of the containers, an area of reduced structural integrity formed in the bottom wall of the web for tearing, and a stack shoulder wall for nesting multi-pack container assemblies that extends vertically below the bottom wall of the web and is connected to the hollow body portion of each container by a horizontal wall that extends around a periphery of the container and has a greater width at the corners than along the sides of the container.

17. A multi-pack container assembly comprising a plurality of containers, each of the containers being formed to include a skirt adjacent an opening to a cavity of the container and a downwardly extending hollow body portion, and an area of reduced structural integrity for tearing, the area connecting skirts of adjacent containers, wherein each skirt of each container includes a top wall adjacent the opening to the container and a bottom wall adjacent the downwardly extending body portion so that each skirt has a cross-sectional thickness, and further wherein each skirt of each container also includes an area of reduced cross-sectional thickness located in proximity to a similar reduced cross-section area on an adjoining skirt.

18. A multi-pack container assembly comprising a plurality of containers, and a web interconnecting the containers, the web including a top and bottom wall and being formed to include a frangible portion between each pair of adjacent containers, the frangible portion including at least one thick portion having a first thickness, as measured between the top and bottom walls, and a thin portion having a second thickness, as measured between the top and bottom walls, the first thickness being greater than the second thickness and the thick and thin portions being located along a longitudinal extent of the web.

19. The multi-pack container assembly of claim 18, wherein each container includes a side wall appended to the web, the frangible portion of the web alongside the side wall includes a spaced-apart pair of thick portions, and the thin portion is situated to lie between the spaced-apart pair of thick portions.

20. The multi-pack container assembly of claim 19, further comprising a plurality of frangible ribs interconnecting adjacent pairs of containers, at least one of the frangible ribs extending across the thin portion of the web and located between the spaced-apart pair of thick portions of the web.

21. The multi-pack container assembly of claim 20, wherein at least one of the frangible ribs is formed to include a thin plate appended to the web and an elongated breakaway portion extending through the thin plate toward the thin portion formed in the web.

22. The multi-pack container assembly of claim 19, wherein each container includes at least one corner, the web includes a corner region lying between four corners of adjacent containers, and the frangible portion of the web is formed to include another thin portion in the corner region.

23. The multi-pack container assembly of claim 22, wherein the other thin portion is cross-shaped.

24. The multi-pack container assembly of claim 22, wherein one of the thick portions of the web is positioned to lie between the thin portion and the other thin portion.

25. The multi-pack container assembly of claim 18, wherein each container includes at least one corner, the web includes a corner region lying between four corners of adjacent containers, and the frangible portion of the web is formed to include another thin portion in the corner region.

26. The multi-pack container assembly of claim 25, wherein the other thin portion is cross-shaped.

27. The multi-pack container assembly of claim 18, wherein each container includes a hollow body portion and a stack shoulder interconnecting the web and the hollow body portion and extending outwardly from the hollow body portion and further comprising a plurality of frangible ribs interconnecting adjacent pairs of containers, each frangible rib having one edge appended to the stack shoulder of one container and another edge appended to the stack shoulder of an adjacent container.

28. The multi-pack container assembly of claim 27, wherein at least one of the frangible ribs extends across the thin portion of the web and lies between the spaced-apart pair of thick portions of the web.

29. The multi-pack container assembly of claim 17, wherein the reduced cross-sectional areas of four containers are located adjacent one another and are connected together by the area of reduced structural integrity.

* * * * *